US007210715B2

(12) United States Patent
Kobayashi et al.

(10) Patent No.: US 7,210,715 B2
(45) Date of Patent: May 1, 2007

(54) DOOR HANDLE DEVICE

(75) Inventors: Norikazu Kobayashi, Chita (JP); Yuichi Murakami, Chiryu (JP); Koji Aoki, Nagoya (JP); Katsutoshi Fukunaga, Chiryu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 214 days.

(21) Appl. No.: 10/671,544

(22) Filed: Sep. 29, 2003

(65) Prior Publication Data

US 2004/0125545 A1 Jul. 1, 2004

(30) Foreign Application Priority Data

Sep. 27, 2002 (JP) ..... 2002-284172

(51) Int. Cl.
*E05B 3/00* (2006.01)

(52) U.S. Cl. ..... 292/336.3; 70/256; 70/237; 292/DIG. 25

(58) Field of Classification Search ..... None
See application file for complete search history.

(56) References Cited

U.S. PATENT DOCUMENTS

| | | | | |
|---|---|---|---|---|
| 5,682,135 | A * | 10/1997 | Labonde | 340/426.17 |
| 5,844,470 | A * | 12/1998 | Garnault et al. | 340/5.62 |
| 5,901,991 | A * | 5/1999 | Hugel et al. | 292/201 |
| 6,075,294 | A * | 6/2000 | Van den Boom et al. | 307/10.1 |
| 6,181,024 | B1 * | 1/2001 | Geil et al. | 307/10.2 |
| 6,218,933 | B1 * | 4/2001 | Josserand et al. | 340/426.28 |
| 6,239,693 | B1 * | 5/2001 | Benard et al. | 340/426.26 |
| 6,260,392 | B1 * | 7/2001 | Geiger | 70/276 |
| 6,325,429 | B1 * | 12/2001 | Oxley | 292/341.16 |
| 6,367,295 | B1 * | 4/2002 | Agostini et al. | 70/257 |
| 6,490,896 | B2 * | 12/2002 | Segawa | 70/208 |
| 6,588,813 | B1 * | 7/2003 | Marcarini et al. | 292/347 |
| 6,774,789 | B2 * | 8/2004 | Inaba et al. | 340/541 |
| 6,883,840 | B2 * | 4/2005 | Sueyoshi et al. | 292/336.3 |
| 6,933,831 | B2 * | 8/2005 | Ieda et al. | 340/5.72 |

FOREIGN PATENT DOCUMENTS

| | | |
|---|---|---|
| DE | 100 43 289 A1 | 3/2002 |
| EP | 0 999 324 A2 | 5/2000 |
| FR | 2 772 818 A1 | 6/1999 |
| FR | 2 802 562 A1 | 6/2001 |
| FR | 2 820 448 A1 | 8/2002 |
| JP | 2002-30844 A | 1/2002 |

* cited by examiner

*Primary Examiner*—John B. Walsh
(74) *Attorney, Agent, or Firm*—Buchanan Ingersoll & Rooney PC

(57) ABSTRACT

A door handle device includes a frame fixed to the inside of an outer panel of a vehicle door and a grip provided on the frame from the outside of a vehicle and including an electrical component. The frame is integrally provided with a circuit electrically connected to the electrical component. The door handle device further includes a chassis integrally formed with the frame, and the circuit is provided within the chassis.

15 Claims, 8 Drawing Sheets

DOOR HANDLE DEVICE

CROSS REFERENCE TO RELATED APPLICATIONS

The application is based on and claims priority under 35 U.S.C. § 119 with respect to a Japanese Patent Application 2002-284172, filed on Sep. 27, 2002, the entire content of which is incorporated herein by reference.

FIELD OF THE INVENTION

This invention generally relates to a door handle device. More particularly, this invention pertains to a door handle device applied to a vehicle door.

BACKGROUND OF THE INVENTION

For example, a known door handle device is disclosed in a Japanese Patent Laid-open Publication No. 2002-30844. This door handle device includes a handle frame and a handle grip. The handle frame is fixed to an outer panel of a vehicle door. The handle grip is provided on the handle frame from the outside of a vehicle through the outer panel, and electrical components are included in the handle grip.

In the door handle device, the handle grip includes an antenna as one of the electrical components. The antenna transmits an identification signal with predetermined frequency to the outside of the vehicle. An oscillating circuit for keeping the antenna oscillating is provided between an inner panel of the vehicle door and a door trim through harness. In this case, since a window glass is located in the vehicle door, the harness connecting the antenna to the oscillating circuit has to be provided so as not to interfere with the window glass. Thus, wiring structure between the antenna and the oscillating circuit cannot be simplified, and noise may be generated due to the complicated wiring structure.

The present invention therefore seeks to provide a door handle device in which wiring structure between electric components provided within a door handle and a circuit connected to the electric components is simplified.

SUMMARY OF THE INVENTION

According to an aspect of the present invention, a door handle device includes a frame fixed to the inside of an outer panel of a vehicle door and a grip provided on the frame from the outside of a vehicle and including an electrical component. The frame is integrally provided with a circuit electrically connected to the electrical component.

According to another aspect of the present invention, the door handle device further includes a chassis integrally formed with the frame, and the circuit is provided within the chassis.

BRIEF DESCRIPTION OF THE DRAWING FIGURES

The foregoing and additional features and characteristics of the present invention will become more apparent from the following detailed description considered with reference to the accompanying drawing figures wherein.

DETAILED DESCRIPTION OF THE INVENTION

Hereinafter, an embodiment of the present invention is described with reference to FIGS. 1–8. In this embodiment, a door handle device 10 according to the present invention is applied to a smart entry system 50 (hereinafter referred to as a system 50). The system 50 is a door locking/unlocking system in which a vehicle door being in a locked state is switched to an unlocked state when an owner of a vehicle (hereinafter referred to as a user) is close to the vehicle and a hand of the user approaching the door handle device 10 is detected.

Figure 1:
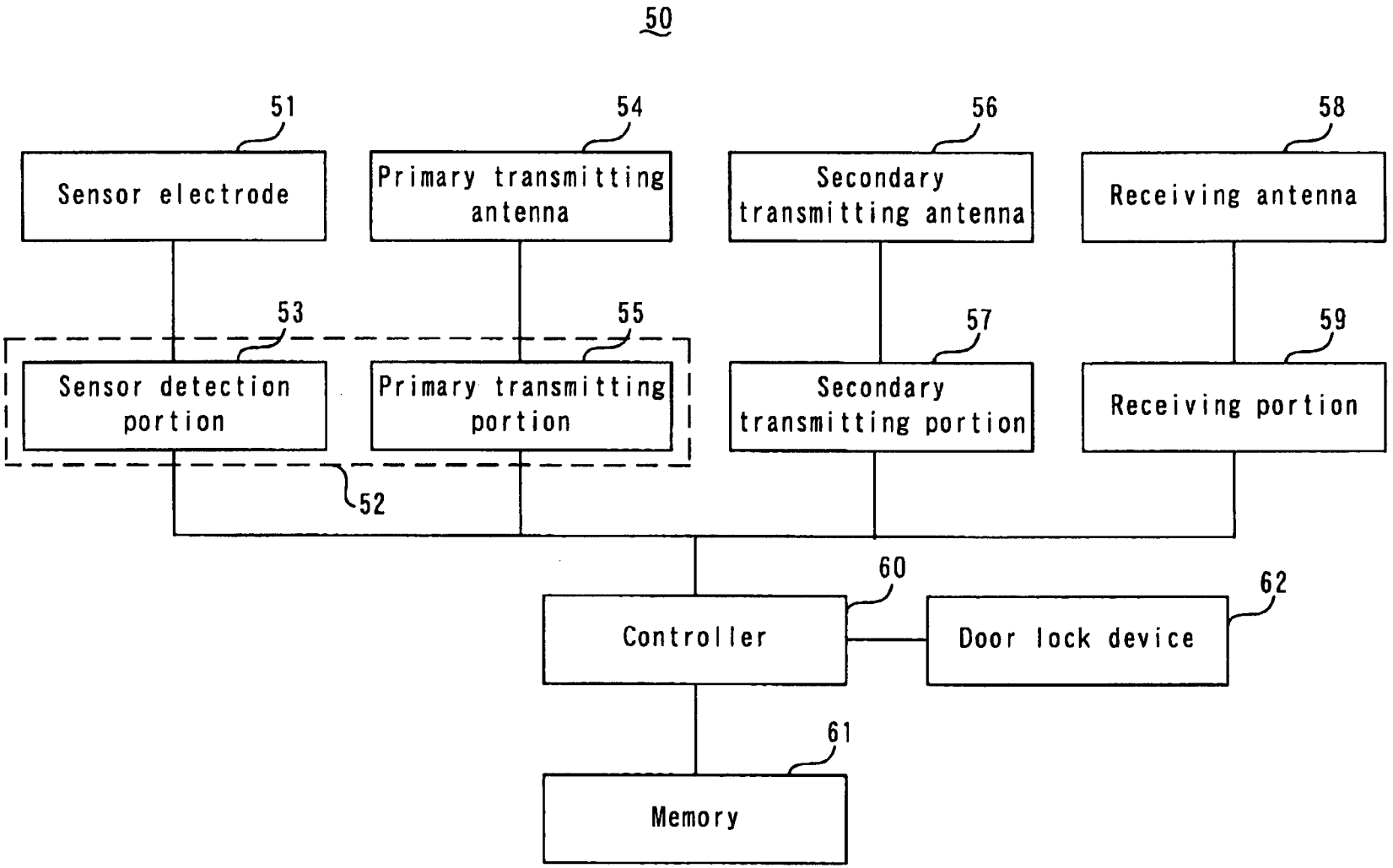
FIG. 1 shows a configuration of a smart entry system including a door handle device according to the present invention.

First, the system 50 is briefly explained with reference to FIG. 1 and FIG. 2. The system 50 includes a primary transmitting antenna 54 (an electrical component) communicating with the outside of the vehicle and a secondary transmitting antenna 56 communicating with the inside of the vehicle. The primary transmitting antenna 54 is provided within the door handle device 10 (shown in FIG. 3) mounted to a vehicle door 30 (shown in FIG. 3), and the secondary transmitting antenna 56 is provided within an instrument panel in a vehicle compartment. The primary transmitting antenna 54 is connected to a primary transmitting portion 55, and the secondary transmitting antenna 56 is connected to a secondary transmitting portion 57. The primary transmitting portion 55 and the secondary transmitting portion 57 are connected to a controller 60.

In the door handle device 10, a sensor electrode 51 (an electrical component) is provided. The sensor electrode 51 detects the user approaching the vehicle door 30 based on variation of capacitance and connected to a sensor detection portion 53. The sensor detection portion 53 detects the user based on information from the sensor electrode 51 and connected to the controller 60. In this embodiment, the sensor detection portion 53 and the primary transmitting portion 55 are integrally included in a single unit as a signaling circuit 52 (a circuit), and yet can be separately provided. Explanation concerning the signaling circuit 52 will be provided later.

The controller 60 respectively transmits a primary request signal (hereinafter referred to as an outside request signal) and a secondary request signal (hereinafter referred to as an inside request signal) to the primary transmitting portion 55 and the secondary transmitting portion 57. In this embodiment, both antennae 54 and 56 transmit the request signals with frequency of 134 kHz to a portable device 70 (shown in FIG. 2).

The vehicle is provided with a receiving antenna 58, and an identification signal outputted from the portable device 70 is received by the receiving antenna 58. In this embodiment, the identification signal has frequency of 300 MHz. This identification signal is demodulated at a receiving portion 59 and then inputted to the controller 60.

The controller 60 is connected to a door lock device 62 provided on the vehicle door 30. In the door lock device 62, switching between a locked state and an unlocked state is performed by the controller 60. As regarding various switches and sensors connected to the controller 60 (for example, a courtesy switch which detects whether the vehicle door 30 is opened or closed to the vehicle), detailed explanation is omitted.

Figure 2:
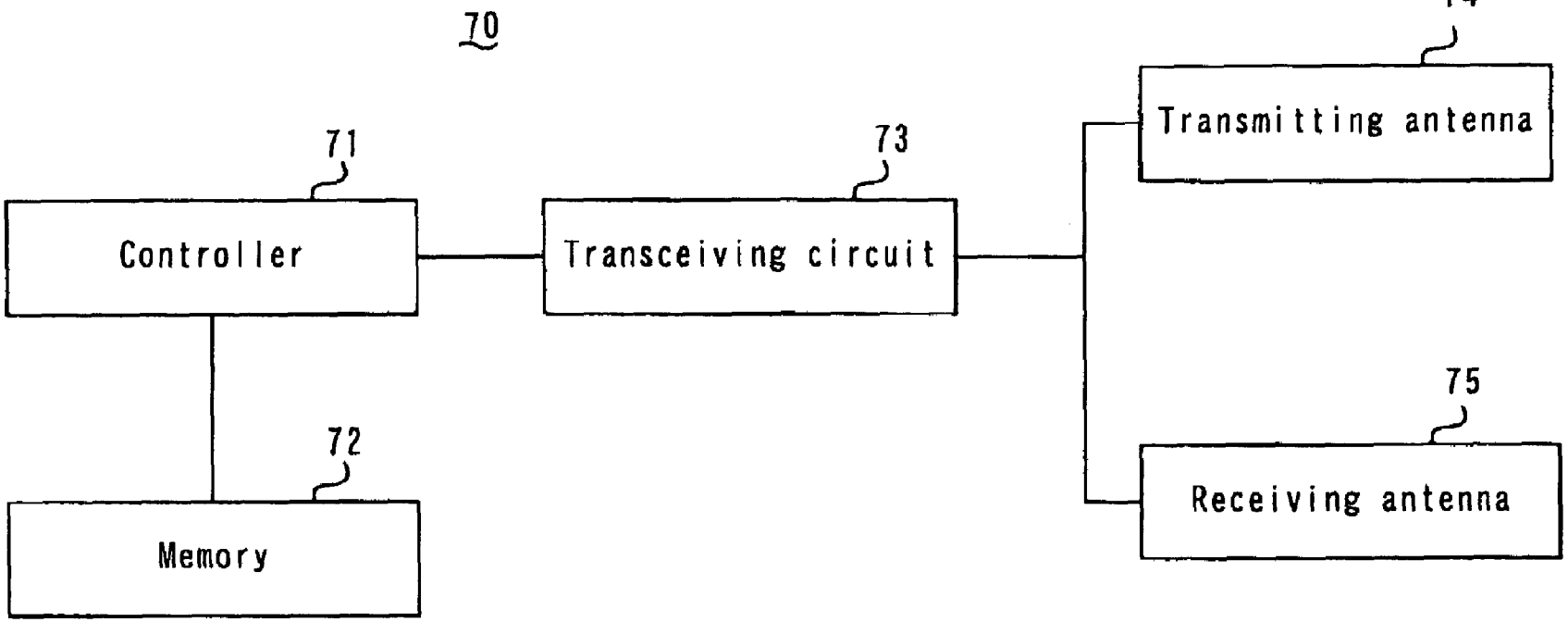
FIG. 2 shows a configuration of a smart entry system including a door handle device according to the present invention.

FIG. 2 shows a system configuration of the portable device 70 applied to the system 50. The portable device 70 includes a transmitting antenna 74 and a receiving antenna 75. The transmitting antenna 74 transmits the identification signal with frequency of 300 MHz to the vehicle. The receiving antenna 75 receives the outside/inside request signals with frequency of 134 kHz transmitted from the vehicle. The transmitting antenna 74 and the receiving antenna 75 are connected to a transceiving circuit 73. The transceiving circuit 73 is connected to a controller 71.

The request signal from the vehicle received by the receiving antenna 75 is inputted to the controller 71 trough the transceiving circuit 73. The controller 71 transmits a response signal, which includes an identification code having been memorized in a memory 72, to the transceiving circuit 73 responding to the request signal. The response signal is modulated at the transceiving circuit 73 and then transmitted to the vehicle with frequency of 300 MHz from the transmitting antenna 74.

Next, operation of the system 50 is explained below. When the door lock device 62 of the vehicle door 30 is in the locked state, if the user exists within a predetermined distance from the vehicle, the outside request signal transmitted from the primary transmitting antenna 54 can be transmitted to the receiving antenna 74 of the portable device 70 of the user. In the portable device 70, as described above, the controller 71 transmits the response signal responding to the outside request signal.

When the response signal transmitted from the transmitting antenna 74 of the portable device 70 is received by the receiving antenna 58 of the vehicle, the identification code demodulated by the receiving portion 59 is checked against an identification code having been memorized in a memory 61 by the controller 60. After the check between the identification codes is approved, the controller 60 is in an unlock standby state.

When the hand of the user approaches the door handle 10, variation of capacitance is generated between the sensor electrode 51 and the sensor detection portion 53. After the hand of the user approaching the sensor electrode 51 is detected based on the variation of capacitance, a detection signal is transmitted to the controller 60 from the sensor detection portion 53. Responding to the detection signal, the controller 60 transmits a switching signal for switching to the unlocked state to the door lock device 62. Then, an actuator (not shown) in the door lock device 62 is operated, and the locked state is switched to the unlocked state in the door lock device 62.

Figure 3:
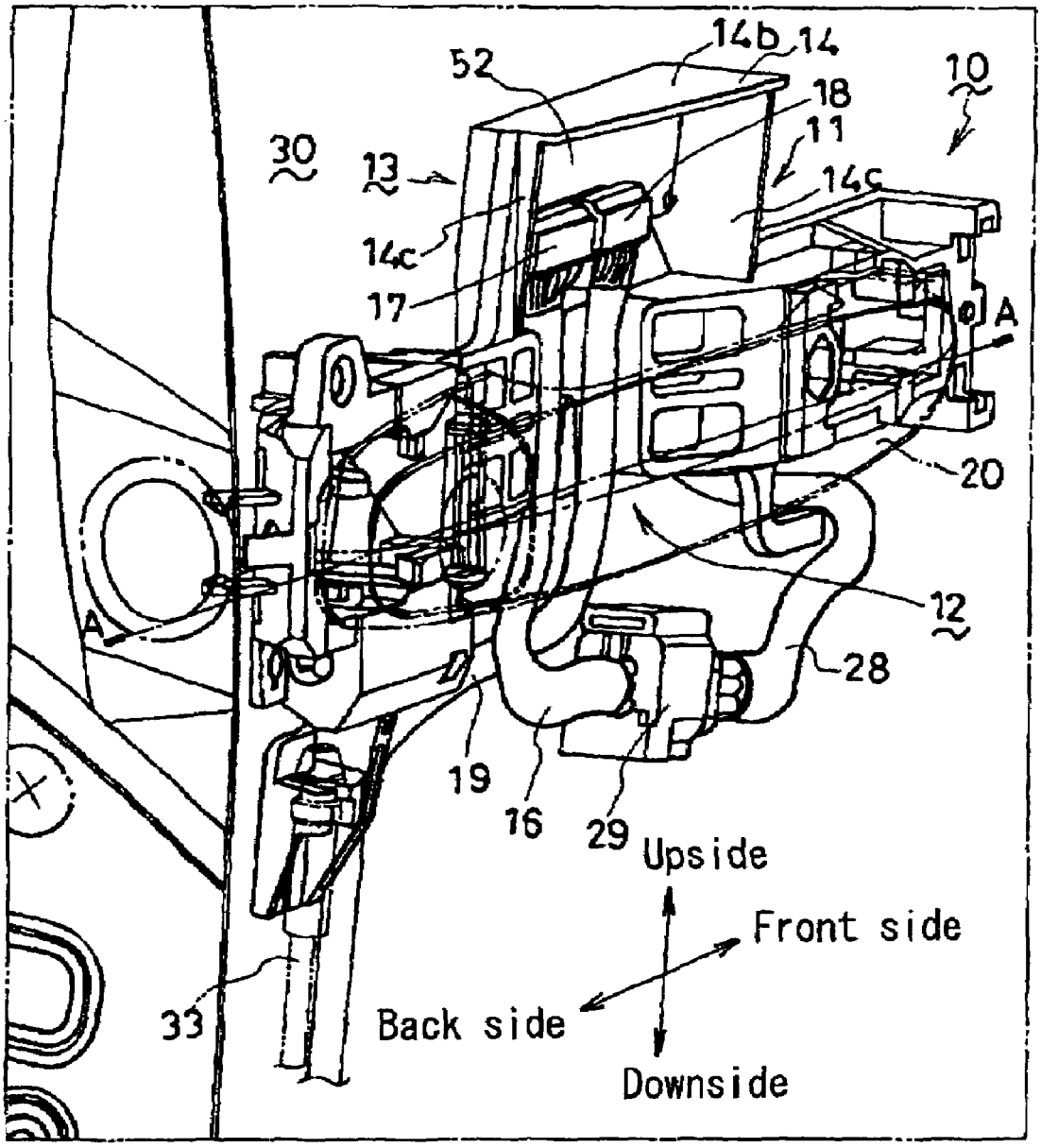
FIG. 3 is a perspective view of a vehicle door to which a door handle device according to the present invention is mounted.

Next, with reference to FIGS. 3–8, structure of the door handle 10 applied to the system 50 is specifically explained. FIG. 3 shows a perspective view of the vehicle door 30 to which the door handle 10 is mounted. The vehicle door 30 is a swing-type vehicle door at a driver's seat. In FIG. 3, an outer panel of the vehicle door 30 is omitted for the purpose of simplification.

Figure 4:
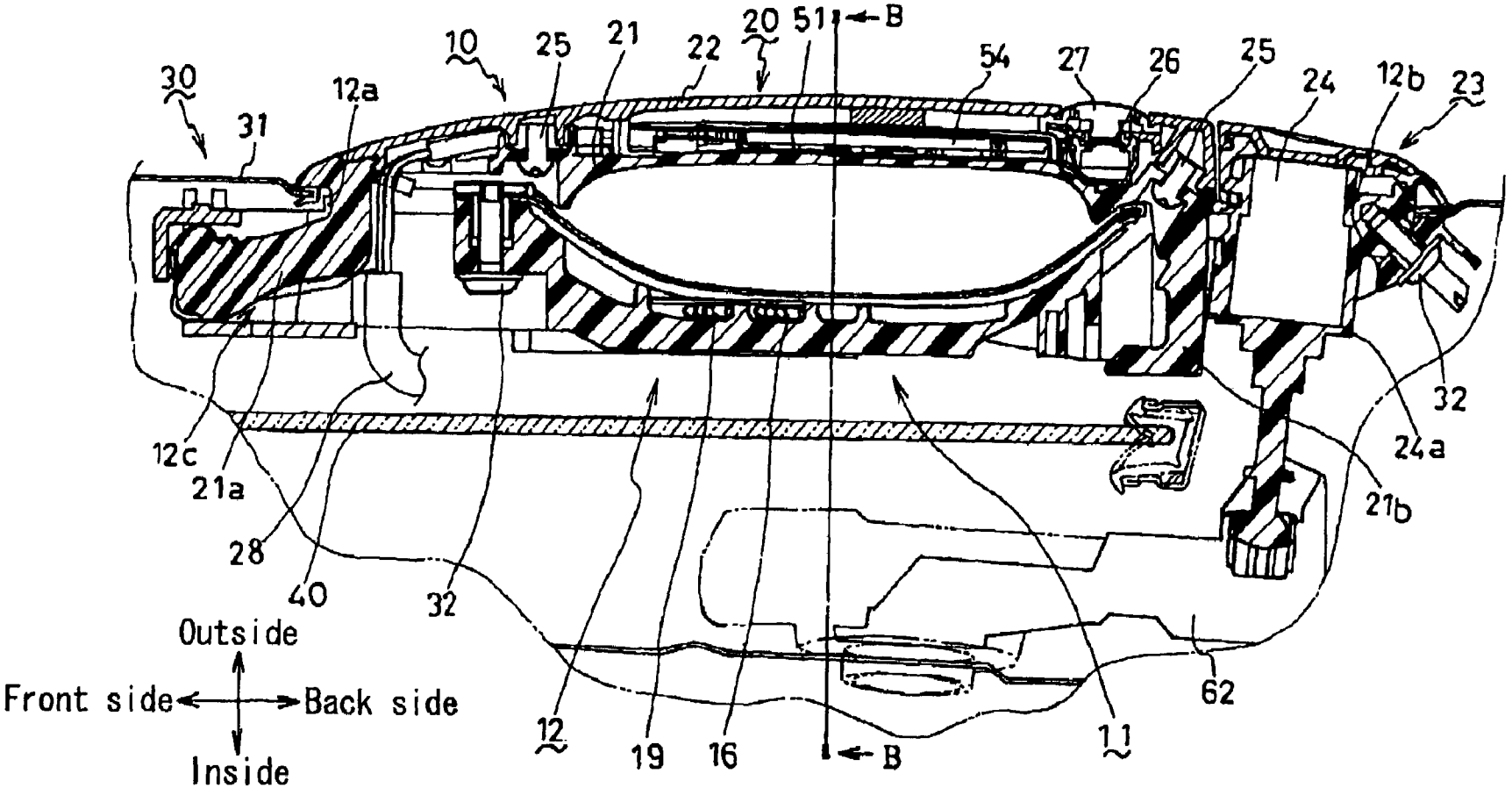
FIG. 4 is a cross sectional view taken along the line A—A of FIG. 3.

The door handle 10 mainly includes a frame 11 and a grip 20. As shown in FIG. 4, the frame 11 is fixed to the inside of an outer panel 31 of the vehicle door 30 by using two screws 32. The frame 11 is resinous and integrally includes a main frame 12 and a chassis 13, as shown in FIGS. 3–8 in detail.

Figure 6:
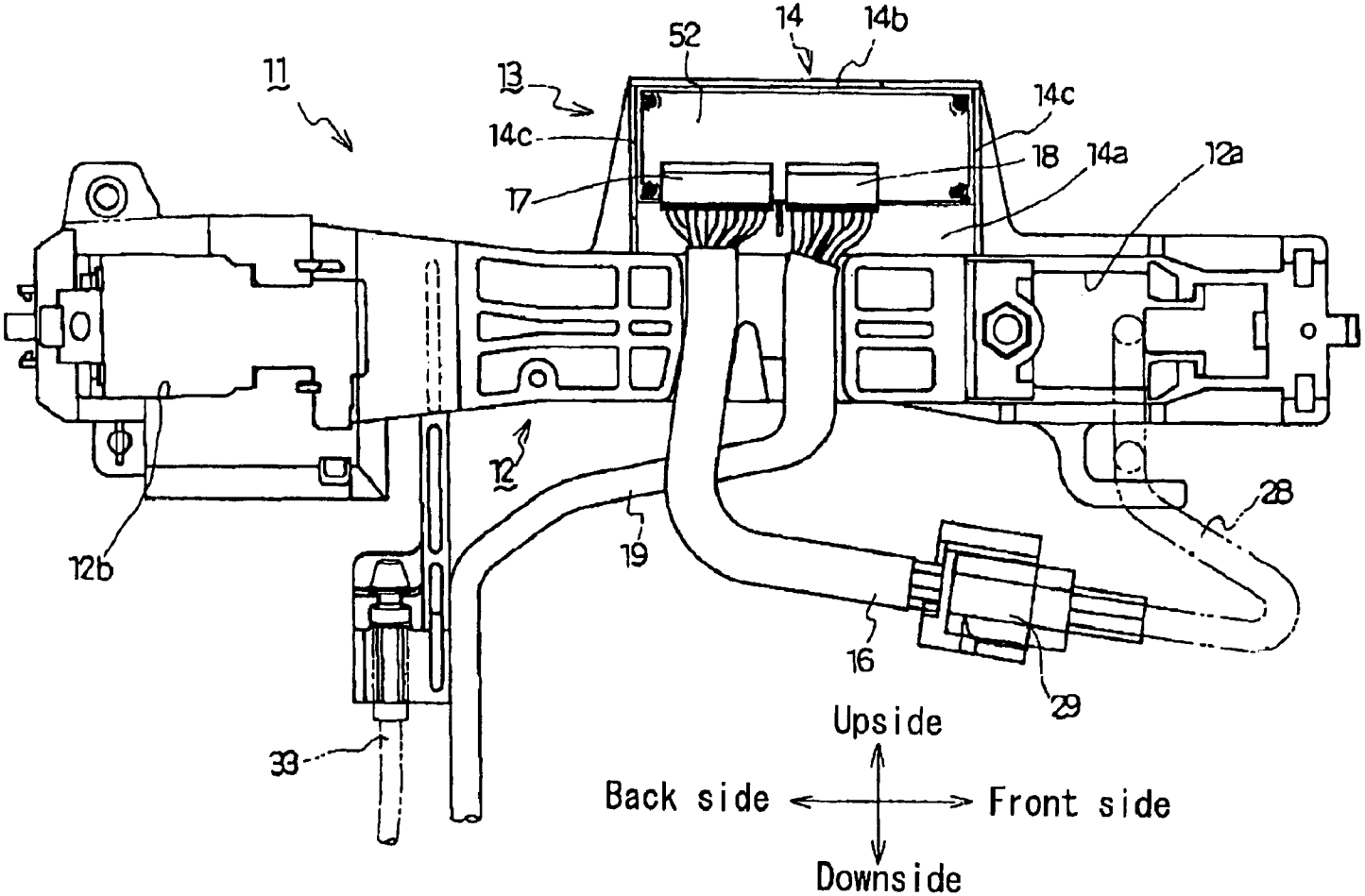
FIG. 6 is a plane view of a frame of the door handle device according to the present invention.
Figure 7:
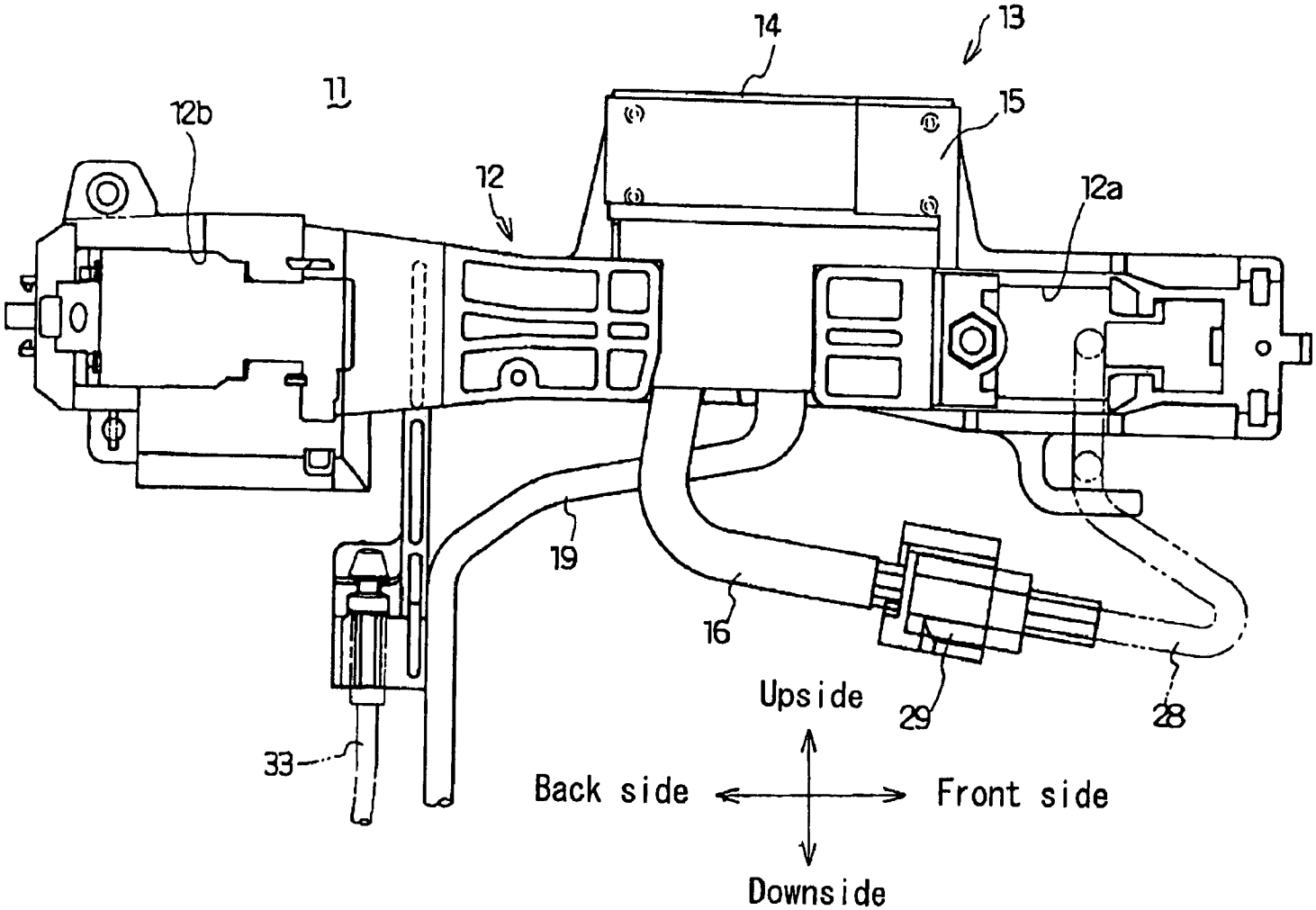
FIG. 7 is a plane view of the frame on which a cover portion is provided.

As shown in FIG. 4, the main frame 12 extends in directions of the front and back side of the vehicle (a longitudinal direction of the vehicle), and the outside of the main frame 12 has a curved shape. This curved shape of the main frame 12 corresponds to a curved shape formed on the outer panel 31. As shown in FIG. 6 and FIG. 7, the main frame 12 includes opening portions 12*a* and 12*b* at the front and back side of the vehicle respectively. In the opening portion 12*a*, an arm 21*a* of a grip 20 (say later) is inserted. In the opening portion 12*b*, a handle lever 21*b* of the grip 20 (say later) and a cylinder case portion 24 of a key cylinder 24 fixed to a cap 23 (say later) are inserted.

Figure 5:
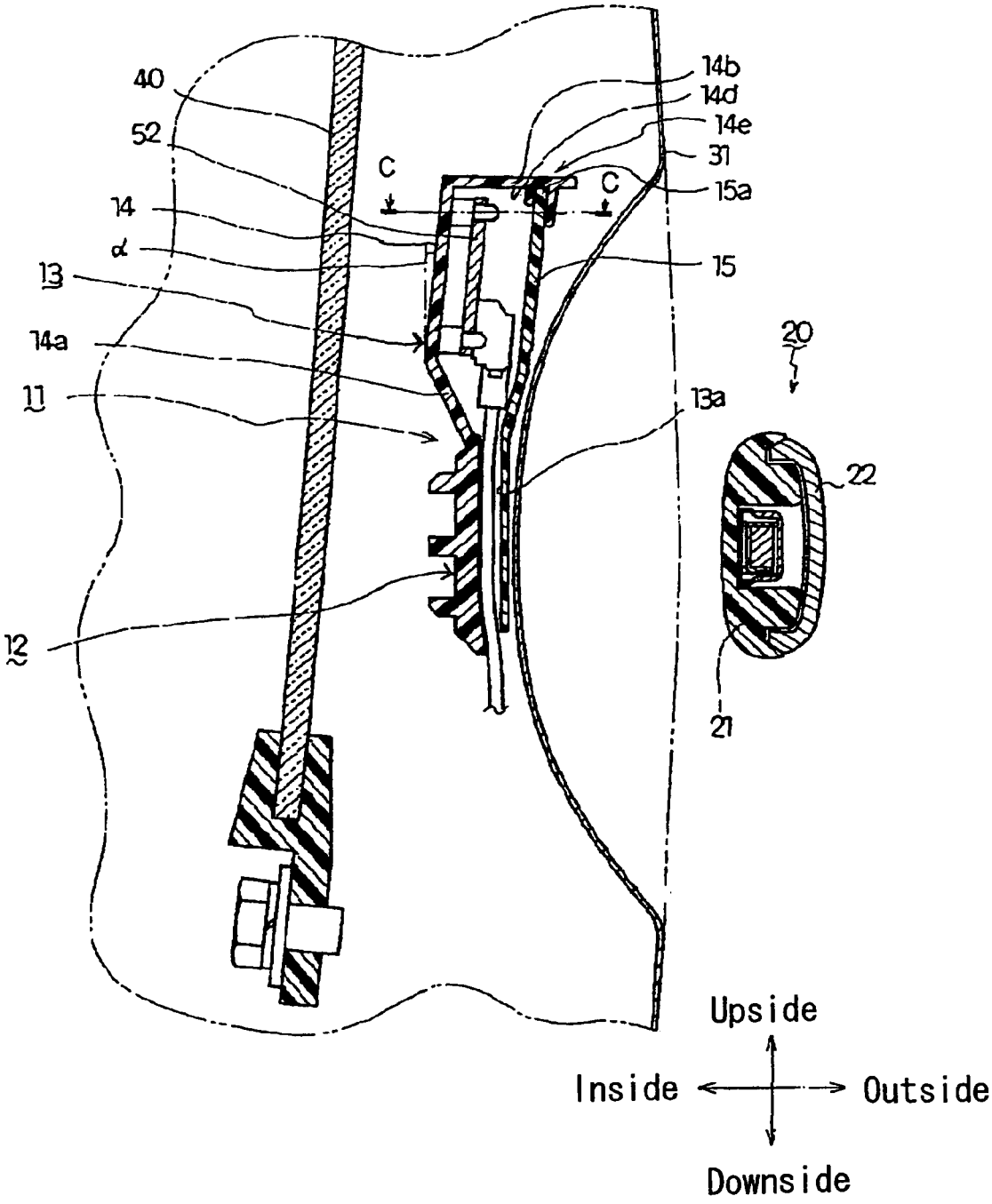
FIG. 5 is a cross sectional view taken along the line B—B of FIG. 4.
Figure 8:
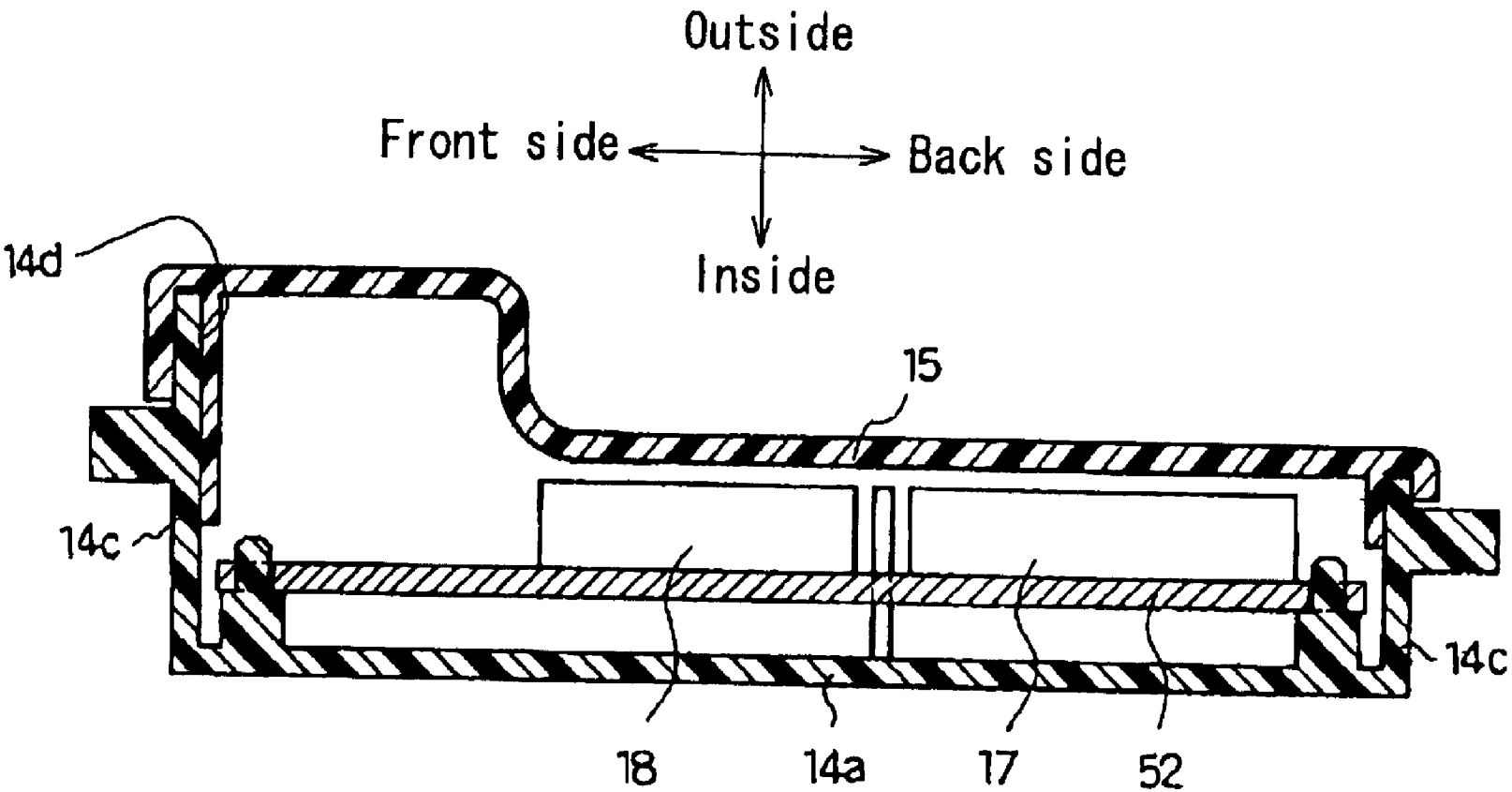
FIG. 8 is a cross sectional view taken along the line C—C of FIG. 5.

Next, structure of the chassis 13 is explained. As shown in FIGS. 5–8, the chassis 13 mainly includes a case portion 14 and a cover portion 15. The case portion 14 further includes a base wall portion 14*a*, an upper wall portion 14*b*, and two lateral wall portions 14*c*. The base wall portion 14*a* is formed at an approximately middle part of the main frame 12 so as to have predetermined width along the longitudinal direction of the vehicle and to extend integrally upward from the main frame 12. As shown in FIG. 5, the base wall portion 14*a* has a bended-shaped cross section, and an upper side of the base wall portion 14*a* is aslant outside (at an angle of a degrees to a perpendicular line). The upper wall portion 14*b* is formed so as to extend outside from an upper end of the base wall portion 14*a*. As shown in FIG. 8, each lateral wall portion 14*c* is formed so as to extend outside from both lateral ends of the base wall portion 14*a*. As explained above, the case portion 14 includes an outer opening portion 14*d* opening outside.

As shown in FIG. 5, the cover portion 15 is fixed to the case portion 14 so that the outer opening 14*d* of the case portion 14 can be covered. An upper side of the cover portion 15 is aslant outside so as to be parallel with the upper side of the base wall portion 14*a*, and an upper end 15*a* of the cover portion 15 is connected to the upper wall portion 14*b*. A connected portion 14*e* between the upper end 15*a* and the upper wall portion 14*b* has what we call a labyrinthine structure in which the upper end 15*a* is held between a pair of flanges formed so as to extend downward from the upper wall portion 14*b*. Further, the upper wall portion 14*b* extends outside beyond a position of the connected portion 14*e*. According to the labyrinthine structure and the upper wall portion 14*b* extending beyond the connected portion 14*e*, if the chassis 13 is watered from above, water is difficult to enter in the chassis 13. Thus, the chassis 13 has a good water proofing property concerning the signaling circuit 52 provided within the chassis 13. In addition, as shown in FIG. 8, each lateral wall portion 14*c* is connected to both lateral ends of the cover portion 15 so that each lateral wall 14*c* can be held between a pair of flanges formed on the cover portion 15. That is, the lateral wall portions 14*c* are connected to the cover portion 15 by means of the labyrinthine structure in common with the connected portion 14*e*.

As shown in FIG. 5 and FIG. 7, a lower side of the cover portion 15 extends so as to face the main frame 12. The cover portion 15 is located outside at a predetermined distance from the main frame 12, and the chassis 13 includes a lower opening portion 13*a* opening downward.

Next, explanation concerning the grip 20 is provided. As shown in FIG. 4 and FIG. 5, the grip 20 includes a base 21 and a cover 22 made from metal or resin. The cover 22 is fixed to the base 21 by using two screws 25, and a space is provided within the grip 20. The arm 21*a* and the handle lever 21*b* are formed at the front and back side of the grip 20 respectively. The grip 20 is assembled to the main frame 12 by inserting the handle lever 21*b* in the opening portion 12*b* after the arm 21*a* is inserted in a receiving space 12*c* through the opening portion 12*a* of the main frame 12. Then, the grip 20 is fixed to the outer panel 31 of the vehicle door 30. In the grip 20 assembled to the outer panel 31, the handle lever 21*b* is connected to a cable 33 (shown in FIG. 6) through a crank mechanism (not shown). The cable 33 is connected to an outside opening lever (not shown) operating the door lock device 62. Thus, when the grip 20 is operated so as to be pivoted about the arm 21*a* on the vehicle door 30, the outside opening lever of the door lock device 62 is operated. Then a latch mechanism (not shown) is operated, and the vehicle door 30 is opened.

As shown in FIG. 4, the cap 23 is fixed to the vehicle door 30 at the back side relative to the grip 20. The cap 23 is formed so that outer design of the cap 23 can be identical with that of the grip 20, and the key cylinder 24 and the cylinder case 24*a* are provided within the cap 23. The cylinder case 24*a* is directly connected to the door lock device 62 through the opening portion 12*b* of the main frame 12, and then operation of the key cylinder 24 is transmitted to the door lock device 62.

As shown in FIG. 4, the primary transmitting antenna 54, the sensor electrode 51, and a lock switch 26 are provided within the space of the grip 20. The primary transmitting antenna 54 is made of a ferrite core where wire is coiled so as to be biaxial and functions as a biaxial antenna. The sensor electrode 51 extends in the longitudinal direction of the vehicle and made of nonmagnetic and conductive materials such as copper and brass. The sensor electrode 51 is provided along the base 21 within the space of the grip 20, and then the hand of the user approaching a space between the grip 20 and the outer panel 31 can be easily detected. The lock switch 26 is membrane switch pushed by a lock switch button 27 provided on the cover 22 of the grip 20. When the user is close to the vehicle, the unlocked state is switched to the locked state in the door lock device 62 by the controller 60 if the lock switch 26 is pushed.

The primary transmitting antenna 54, the sensor electrode 51, and the lock switch 26 are connected to harness 28 (a connecting member). The harness 28 extends within the vehicle door 30 through an opening provided on the base 21.

As shown in FIG. 5, FIG. 6, and FIG. 8, a board of the signaling circuit 52 is provided within an inner space formed by the chassis 13. i.e., the board is disposed between the outer door panel 31 and an element defined by the main frame 12 and the case portion 14. The signaling circuit 52 is fixed to ribs formed on the case wall portion 14 by welding. The harness 28 extending from the grip 20 is, as shown in FIG. 6, connected to the signaling circuit 52 through a pair of connector 29, harness 16 (a connecting member), and a connector 17. That is, in the door handle 10, the signaling circuit 52, which is electrically connected to the primary transmitting antenna 54, the sensor electrode 51, and the lock switch 26 provided on the grip 20, and the main frame 12 are integrally provided. Further, the signaling circuit 52 is connected to harness 19 through a connector 18, and the harness 19 is connected to a board (not shown) provided within the door lock device 62 through an opening (not shown) formed on a housing of the door lock device 62. The board of the door lock device 62 is connected to the controller 60 provided on the vehicle through another harness (not shown).

As explained above, in the door handle 10, the signaling circuit 52 and the main frame 12 are integrally provided. Thus, the harness 28 and the harness 16 for connection between the signaling circuit 52 and the primary transmitting antenna 54 may have length being capable of connecting between the grip 20 and the main frame 12. That is, the connection can be simplified, and generation of noise can be prevented.

In this embodiment, as described above, the primary transmitting antenna 54 of the door handle 10 is electrically connected to the controller 60 through the door lock device 62. That is, the harness between the door lock device 62 and the controller 60 and the harness between the primary transmitting antenna 54 of the door handle 10 and the controller 60 are unified, then wiring structure can be simplified. Especially, since various members such as a window glass 40 (shown in FIG. 4 and FIG. 5) are provided in the vehicle door 30, the simplification of the wiring structure is very effective.

Further, in the chassis 13 of the door handle 10, the harness 16 and the harness 19 extend through the lower opening portion 13*a* opening downward. That is, if the chassis 13 is watered from above, water is difficult to enter in the chassis 13 through the lower opening portion 13*a*, and then the chassis 13 has the good water proofing property concerning the signaling circuit 52 provided within the chassis 13.

Further, as shown in FIG. 5, in the door handle 10 according to the embodiment, the harness 16 and the harness 19 are provided along the base wall portion 14*a* integrally extending from the main frame 12. That is, the harness 16 and the harness 19 are separated from the members (the window glass 40) in the vehicle door 30 by the base wall portion 14*a*, and then the base wall portion 14*a* functions as a protector for preventing the harness 16 and the harness 19 from interfering with the window glass 40.

Furthermore, in the door handle 10 according to the embodiment, the upper side of base wall portion 14*a* is aslant outside, as described above. That is, clearance between the upper side of the base wall portion 14*a* and the members (the window glass 40), which are located inside at a distance from the base wall portion 14*a*, can be sufficiently ensured.

According to the present invention, the chassis 13 for protecting the signaling circuit 52 is integrally formed with the main frame 12. Thus, a protector for protecting the signaling circuit 52 does not need to be provided, the number of components can be reduced, and then the door handle 10 can be simplified.

According to the present invention, since the connected portion 14*e* between the upper wall portion 14*b* and the cover portion 15 has the labyrinthine structure, if the chassis 13 is watered from above, water is difficult to enter in the chassis 13 through the connected portion 14*e*. That is, the chassis 13 has the good water proofing property concerning the signaling circuit 52 provided within the chassis 13.

According to the present invention, since the upper wall portion 14*b* extending from the base wall portion 14*a* further extends outside beyond the position of the connected portion 14*e*, if the chassis 13 is watered from above, water is difficult to enter in the chassis 13 through the connected portion 14*e*. That is, the good water proofing property concerning the signaling circuit 52 can be attained.

The principles, preferred embodiments and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

We claim:

1. A door handle device, comprising:

a frame fixed to the inside of an outer panel of a vehicle door;

a grip provided on the frame from the outside of a vehicle and including a sensor electrode for detecting a user approaching the vehicle door based on a variation of capacitance;

a circuit electrically connected to the sensor electrode and mounted in the frame, wherein the circuit is positioned between the frame and the outer panel of the door; and wherein the frame comprises a chassis that includes a lower opening portion opening downward, and a connecting member for connecting the sensor electrode to the circuit extends through the lower opening portion.

2. A door handle device, according to claim 1, wherein the chassis includes a case portion and a cover portion, the case portion including a base wall portion having predetermined width along a longitudinal direction of the vehicle and extending upward from the frame and an outer opening portion opening at least outside, and the cover portion covers the outer opening portion from the outside of the vehicle.

3. A door handle device, according to claim 2, wherein the chassis includes an upper wall portion integrally extending outside from the upper side of the base wall portion, and a connected portion between the upper wall portion and the cover portion has a labyrinthine structure.

4. A door handle device according to claim 1, wherein the circuit that is electrically connected to the sensor electrode is also connected to a controller which is connected to a door lock device.

5. A door handle device, comprising:

a frame fixed to the inside of an outer panel of a vehicle door;

a grip provided on the frame from the outside of a vehicle and including a sensor electrode for detecting a user approaching the vehicle door based on a variation of capacitance;

a circuit electrically connected to the sensor electrode and mounted in the frame, wherein the circuit is positioned between the frame and the outer panel of the door; and wherein the frame comprises a main frame and a chassis, and the chassis includes a case portion and a cover portion, the case portion including a base wall portion having predetermined width along a longitudinal direction of the vehicle and extending upward from the main frame and an outer opening portion opening at least outside, and the cover portion covers the outer opening portion from the outside of the vehicle.

6. A door handle device, according to claim 5, wherein the chassis includes an upper wall portion integrally extending outside from the upper side of the base wall portion, and a connected portion between the upper wall portion and the cover portion has a labyrinthine structure.

7. A door handle device, according to claim 6, wherein the upper wall portion extends outside beyond the connected portion.

8. A door handle device according to claim 5, wherein the circuit that is electrically connected to the sensor electrode is also connected to a controller which is connected to a door lock device.

9. A door handle device, according to claim 5, wherein an upper side of the chassis is aslant outside.

10. A door handle device, according to claim 9, wherein the chassis includes an upper wall portion integrally extending outside from the upper side of the base wall portion, and a connected portion between the upper wall portion and the cover portion has a labyrinthine structure.

11. A door handle device, comprising:

a frame fixed to the inside of an outer panel of a vehicle door;

a grip mounted on the frame and located at an outside of the vehicle door, the grip including a sensor electrode which detects a user approaching the vehicle door;

a signaling circuit electrically connected to the sensor electrode and integrally provided with the frame, the signaling circuit comprising a sensor detection portion which transmits a signal in response to the sensor electrode detecting a user approaching the vehicle door;

a connecting member connecting the sensor electrode to the signal circuit; and wherein the frame comprises a main frame and a chassis, and the chassis includes a case portion and a cover portion, the case portion including a base wall portion having predetermined width along a longitudinal direction of the vehicle and extending upward from the main frame and an outer opening portion opening at least outside, and the cover portion covers the outer opening portion from this outside of the vehicle.

12. A door handle device, according to claim 11, wherein the chassis includes a lower opening portion opening downward, and the connecting member extends through the lower opening portion.

13. A door handle device, according to claim 11, wherein an upper side of the chassis is aslant outside.

14. A door handle device, according to claim 11, wherein the chassis includes an upper wall portion integrally extending outside from the upper side of the base wall portion, and a connected portion between the upper wall portion and the cover portion has a labyrinthine structure.

15. A door handle device, according to claim 14, wherein the upper wall portion extends outside beyond the connected portion.

* * * * *